US007065814B2

(12) United States Patent
Rutkowski

(10) Patent No.: US 7,065,814 B2
(45) Date of Patent: Jun. 27, 2006

(54) INFANT RESTRAINING APPARATUS AND SOIL BARRIER

(76) Inventor: Amy Rutkowski, 483 Mancos St., Carbondale, CO (US) 81623

( * ) Notice: Subject to any disclaimer, the term of this patent is extended or adjusted under 35 U.S.C. 154(b) by 0 days.

(21) Appl. No.: 10/657,153

(22) Filed: Sep. 9, 2003

(65) Prior Publication Data

US 2005/0050638 A1 Mar. 10, 2005

(51) Int. Cl.
*A62B 35/00* (2006.01)
*A47C 27/00* (2006.01)

(52) U.S. Cl. ..... 5/655; 5/420; 5/628; 297/484; 128/876

(58) Field of Classification Search ..... 5/424, 5/423, 655, 652, 947, 628; 128/876; 297/484
See application file for complete search history.

(56) References Cited

U.S. PATENT DOCUMENTS 2,834,970 A * 5/1958 Moritz ..... 5/420
3,721,434 A 3/1973 Spies
3,779,599 A * 12/1973 Gottfried ..... 297/253
4,205,669 A 6/1980 Hamann
4,689,844 A * 9/1987 Alivizatos ..... 5/702
5,028,468 A * 7/1991 Taylor ..... 428/71
5,299,336 A 4/1994 Marteeny
5,606,744 A 3/1997 Lindy
5,987,677 A 11/1999 Betker
6,009,874 A 1/2000 Sartin et al.
6,058,535 A * 5/2000 Firkins et al. ..... 5/653
6,237,945 B1 * 5/2001 Aboud et al. ..... 280/733
6,389,624 B1 5/2002 Madole
6,557,192 B1 * 5/2003 Zheng ..... 5/413 R

* cited by examiner

*Primary Examiner*—Sunil Singh
(74) *Attorney, Agent, or Firm*—Hall, Vande Sande & Pequignot

(57) ABSTRACT

Apparatus for restraining an infant during diaper changing and for providing a protective barrier for the changing surface and/or diaper changer. More particularly, apparatus having an adjustable, quick-release strap system for restraining the upper torso (e.g. shoulders) of an infant during a diaper changing operation which preferably includes a padded fabric outer layer which houses a foldable insert barrier layer (for ease of storage or transport) which can be removed for ease of cleaning.

14 Claims, 4 Drawing Sheets

INFANT RESTRAINING APPARATUS AND SOIL BARRIER

FIELD OF THE INVENTION

This invention relates to apparatus for restraining an infant during diaper changing and for providing a protective barrier for the changing surface and/or diaper changer. More particularly, this invention relates to apparatus having an adjustable, quick-release strap system for restraining the upper torso (e.g. shoulders) of an infant during a diaper changing operation which preferably includes a padded fabric pocket/cover which is capable of housing a foldable insert barrier layer (for ease of storage and/or transport) which can be removed for ease of cleaning.

BACKGROUND OF THE INVENTION

It is well known that the process of changing an infant's diaper can be a difficult one. For example, many infants are uncooperative during the diaper changing process or are simply inattentive or easily distracted. In this regard, often during a diaper changing, an infant will attempt to roll and/or squirm (e.g. in an effort to reach or grab nearby objects). While the above situations may be frustrating, if the infant's diaper is being changed on an elevated surface, various safety issues are presented as well. For these and other reasons, it is often necessary to attempt to immobilize an infant by hand or other means during a diaper changing operation. Because it is difficult for an individual to immobilize an infant while simultaneously removing a soiled diaper, cleaning the infant, and then dressing the infant in a clean diaper, apparatus are desired which will aid a person in restraining an infant during a diaper changing procedure. In addition, apparatus are desired which will provide a protective barrier to the changing surface and/or person changing an infant during a diaper change.

Heretofore, various apparatus have been developed in an attempt to address the aforementioned problems. Attention is directed, in this regard, to U.S. Pat. Nos. 3,721,434 and 6,009,874 as representative examples of such apparatus. U.S. Pat. No. 3,721,434 discloses an infant changing board having a single strap for securing an infant at the middle torso region. U.S. Pat. No. 6,009,874 discloses a diaper changing apparatus which includes a vest-like portion for securing the chest and shoulder region of an infant. It is noted, however, that the devices disclosed in each of these references exhibit various drawbacks. For example, the '434 apparatus is not capable of securing the shoulders of an infant and therefore allows an infant to roll from side-to-side. In addition, the '874 apparatus does not handle liquid or other type waste adequately and is not sufficiently portable or foldable and/or lacks a restraining mechanism which is sufficiently adjustable. Furthermore, the '874 apparatus is not adaptable to be used with existing changing pads and/or changing stations.

In view of the above, it is apparent that there exists a need in the art for apparatus which overcomes one or more of the above drawbacks. It is a purpose of this invention to fulfill these needs in the art, as well as other needs which will become apparent to the skilled artisan once given the following disclosure.

SUMMARY OF INVENTION

Generally speaking, this invention fulfills the above-enumerated problems in the art by providing:

apparatus for restraining an infant during a diaper changing operation and for shielding a changing surface and/or diaper changer during a diaper changing operation, the apparatus comprising:

a generally planar shield portion having an upper surface for supporting an infant and a lower surface for contacting a diaper changing support surface, the shield portion comprising a fabric pocket, the fabric pocket having a compartment having an aperture housing at least one generally rigid, removable insert, the insert comprising a generally stiff barrier material, the insert having at least one living hinge portion separating at least two major surfaces of the insert, the at least two major surfaces being foldable one on top of the other such that the shield portion is foldable into a compact unit;

the fabric pocket having a top portion and a bottom portion and a middle portion extending between the top and the bottom portions; and a restraining apparatus for restraining shoulders of an infant during a diaper changing operation, the restraining apparatus comprising an adjustable strap system, the adjustable strap system having at least a right strap and a left strap, the right and left straps connecting to the fabric pocket proximal the top portion at one end and proximal the middle portion at another end, and each the right and left straps including a matable element of a quick release system and being connectable one to the other by engaging the matable elements of the quick release system.

In further embodiments, this invention provides:

apparatus for restraining an infant during a diaper changing operation and for shielding a changing surface and/or diaper changer during a diaper changing operation, the apparatus comprising:

a generally planar shield portion having an upper surface for supporting an infant and a lower surface for contacting a diaper changing support surface, the shield portion comprising a fabric pocket, the fabric pocket having a plurality compartments having apertures separated one from another by restriction portions, each of the plurality of compartments housing one of a plurality of generally rigid, removable inserts, each the insert comprising a generally stiff barrier material;

the fabric pocket being foldable at the restriction portions such that the fabric pocket is foldable into a compact unit;

the fabric pocket having a top portion and a bottom portion and a middle portion extending between the top and the bottom portions; and a restraining apparatus for restraining shoulders of an infant during a diaper changing operation, the restraining apparatus comprising an adjustable strap system, the adjustable strap system having at least a right strap and a left strap, the right and left straps connecting to the fabric pocket proximal the top portion at one end and proximal the middle portion at another end, and each the right and left straps including a matable element of a quick release system and being connectable one to the other by engaging the matable elements of the quick release system.

In yet further embodiments, this invention provides:

apparatus for restraining an infant during a diaper changing operation and for shielding a changing surface and/or diaper changer during a diaper changing operation, the apparatus comprising:

a generally planar shield portion having an upper surface for supporting an infant and a lower surface for contacting a diaper changing support surface, the shield portion comprising a fabric pocket, the fabric pocket having a compartment having an aperture for insertion of a changing pad or board therein;

the fabric pocket having a top portion and a bottom portion and a middle portion extending between the top and the bottom portions; and a restraining apparatus for restraining shoulders of an infant during a diaper changing operation, the restraining apparatus comprising an adjustable strap system, the adjustable strap system having at least a right strap and a left strap, the right and left straps connecting to the fabric pocket proximal the top portion at one end and proximal the middle portion at another end, and each the right and left straps including a matable element of a quick release system and being connectable one to the other by engaging the matable elements of the quick release system.

In yet even further embodiments, this invention provides:

In a changing board comprising a changing surface for supporting the weight of an infant during a diaper change, the improvement comprising:

a restraining mechanism for restraining shoulders of an infant during a diaper changing operation, the restraining mechanism comprising an adjustable strap system, the adjustable strap system having at least a right strap and a left strap, the right and left straps connecting to the changing board proximal a top portion at one end and proximal a middle portion at another end, and each of the right and left straps including a matable element of a quick release system and being connectable one to the other by engaging the matable elements of the quick release system, and wherein the right and left straps are so designed and attached to the changing board such that the straps are capable of restraining the shoulders of an infant during a diaper changing operation.

In further embodiments, this invention provides:

apparatus for restraining an infant during a diaper changing operation and for shielding a changing surface and/or diaper changer during a diaper changing operation, the apparatus comprising:

a generally planar shield portion having an upper surface for supporting an infant and a lower surface for contacting a diaper changing support surface, the shield portion comprising a fabric pocket, the fabric pocket having a plurality compartments having apertures separated one from another by restriction portions, each of the plurality of compartments housing one of a plurality of generally rigid, removable inserts, each insert comprising a generally stiff barrier material;

the fabric pocket being foldable at the restriction portions such that the fabric pocket is foldable into a compact unit;

the fabric pocket having a top portion and a bottom portion and a middle portion extending between the top and the bottom portions;

a restraining apparatus for restraining shoulders of an infant during a diaper changing operation, the restraining apparatus comprising an adjustable strap system, the adjustable strap system having at least a right strap and a left strap, the right and left straps connecting to the fabric pocket proximal the top portion at one end and proximal the middle portion at another end, and each the right and left straps including a matable element of a quick release system and being connectable one to the other by engaging the matable elements of the quick release system;

the fabric pocket including an inner liquid permeable shell; and the fabric pocket including an outer liquid permeable shell and a layer of padding sandwiched between said inner and said outer shells.

DETAILED DESCRIPTION OF CERTAIN EMBODIMENTS

Figure 2:
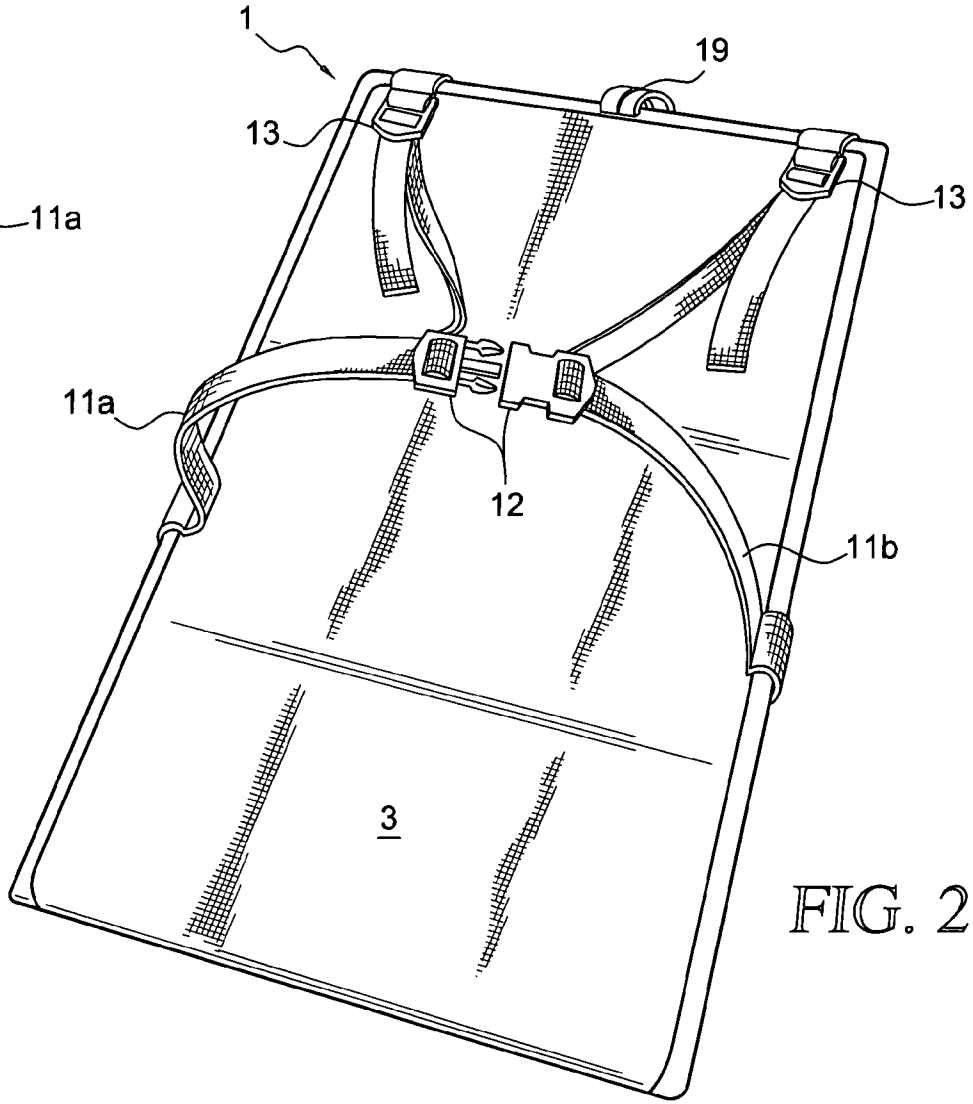
FIG. 2 is a three-dimensional perspective view of the embodiment illustrated in FIG. 1 illustrated in an unfolded configuration.
Figure 1:
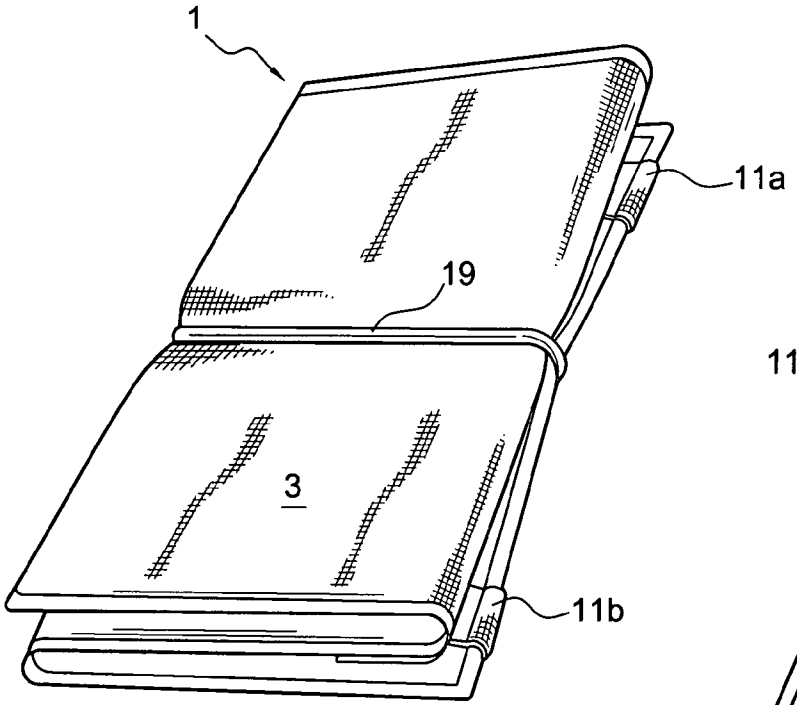
FIG. 1 is a three-dimensional perspective view of one embodiment of the apparatus according to the subject invention illustrated in a folded configuration.

Referring initially to FIGS. 1 and 2, therein is illustrated an exemplar embodiment of an infant restraining apparatus according to the subject invention. As illustrated, infant restraining apparatus 1 generally comprises a shield portion 3 for providing a protective barrier to a changing surface (e.g. floor, changing table, or person) which is connected to a shoulder immobilizing mechanism comprised of left and right straps 11*a* and 11*b* for restraining an infant in a desired position during diaper changes. In the illustrated embodiment, straps 11*a* and 11*b* are connectable one to another via a quick release 12 (e.g. comprising conventional matable male and female elements) and are adjustable in length to accommodate a variety of infant sizes and/or body types (via buckles 13). Straps 11*a–b* are connected at each of their ends to shield portion 3 such that when an infant is secured with the strap system, shield 3 is effectively secured to the infant's back. Although straps 11*a–b* are, as illustrated, simply sewn to shield portion 3, the straps can, of course, be connected by any other suitable means such as by Velcro™ (or other removable connection) so that they can be removed for washing, storage, etc. It is further noted that although apparatus 1 is designed to prevent an infant from rolling, a particularly strong or agile infant (e.g. older or more physically mature children) may be able to sway or roll while wearing apparatus 1, however, the apparatus will typically urge the infant back into a supine position once the infant's initial effort has been exhausted (e.g. much like an inverted turtle unable to right itself). It is further noted that, in some embodiments, apparatus 1 may be attached to a changing surface (e.g. a changing table or other non-mobile or heavy object or surface) so that no rolling whatsoever can occur.

Figure 3:
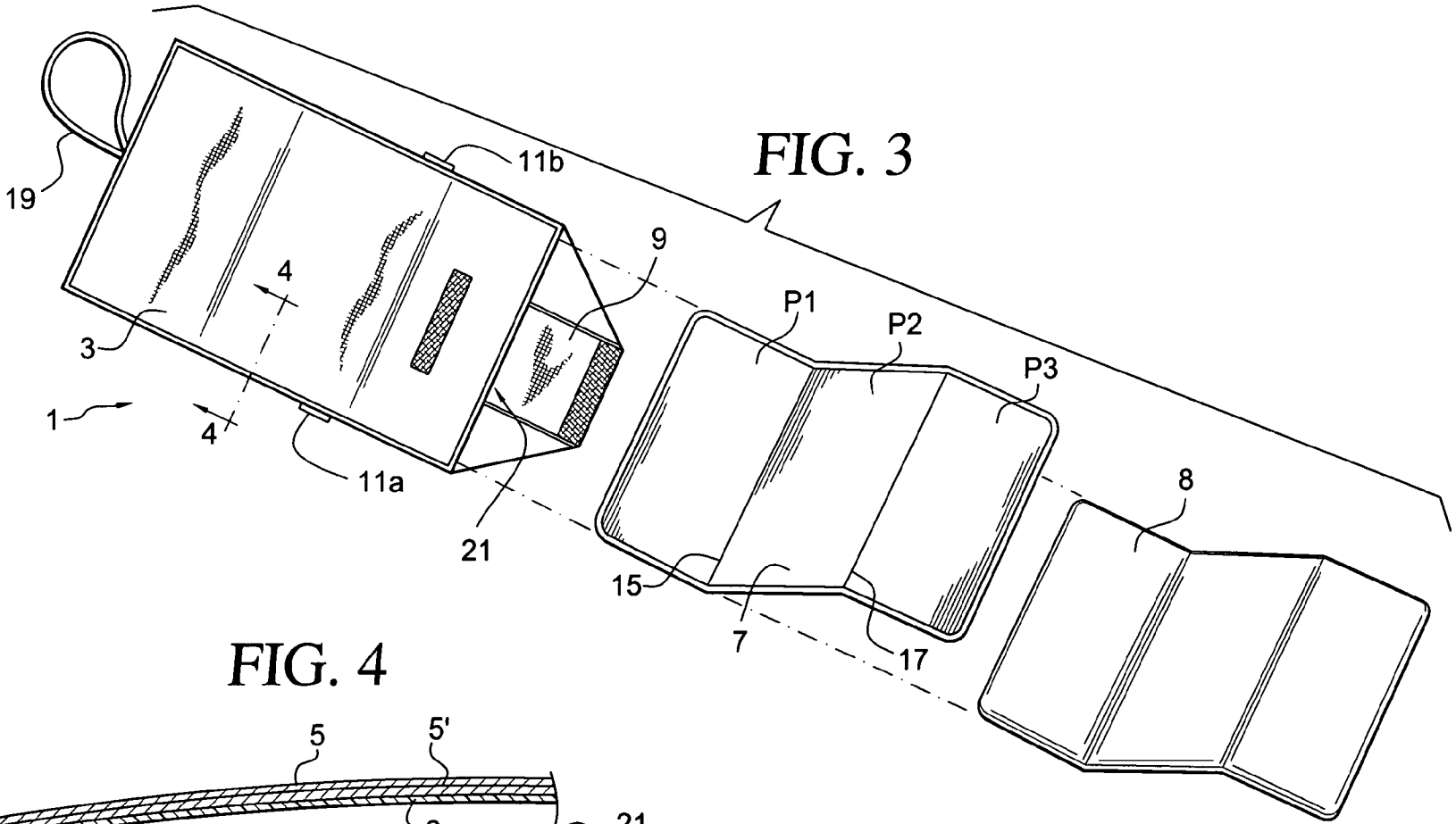
FIG. 3 is a blown-apart view of the embodiment of the subject invention illustrated in FIG. 2.
Figure 4:
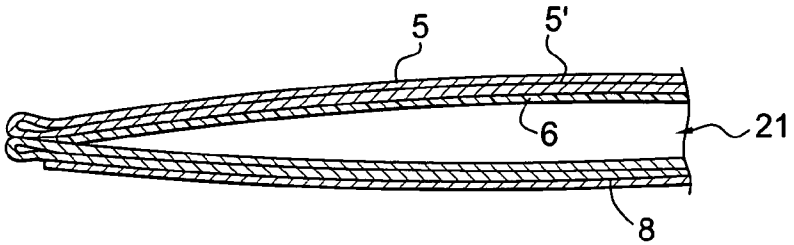
FIG. 4 is a cross-sectional view of the shield portion according to one embodiment of the subject invention.
Figure 5:
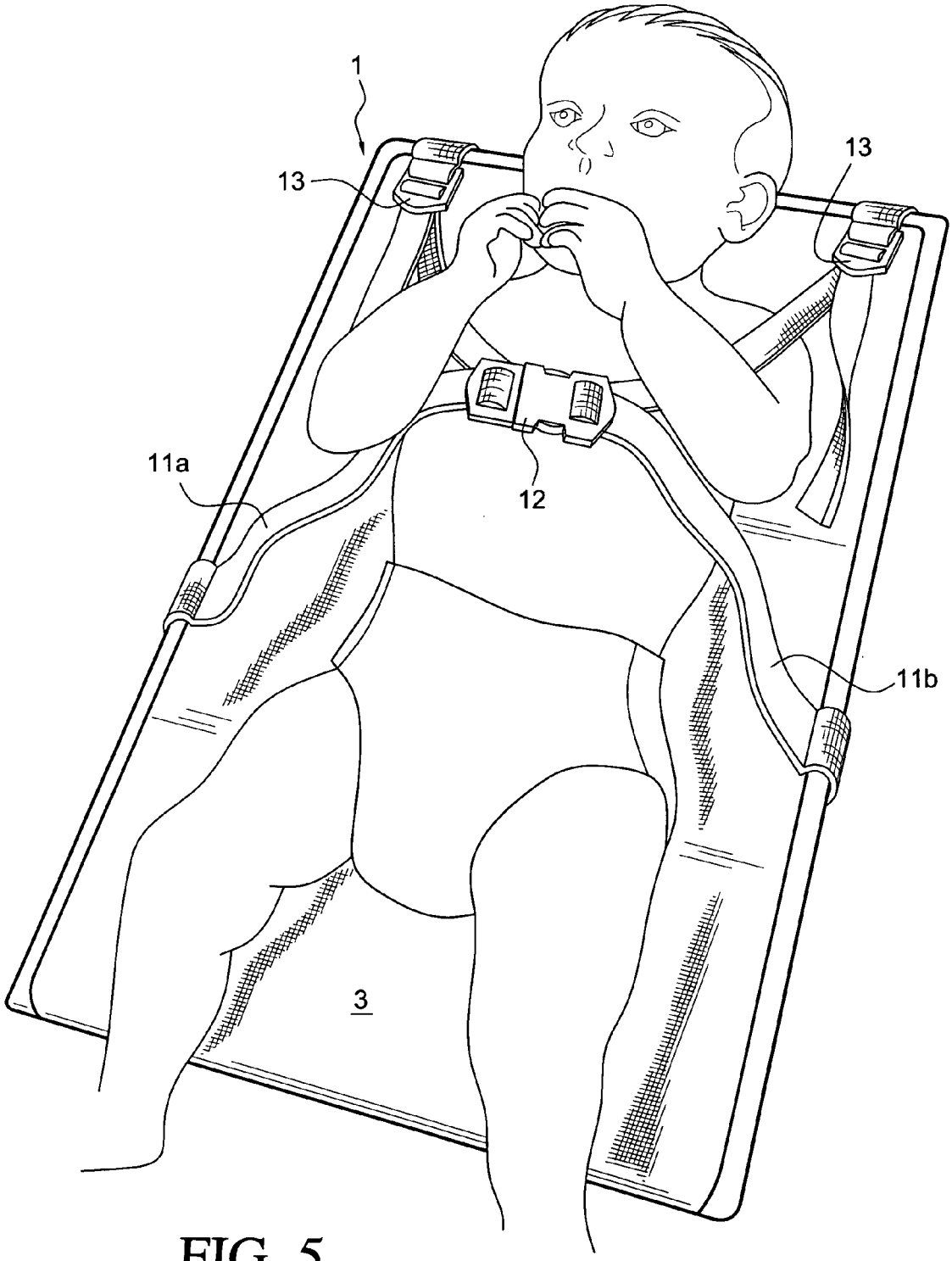
FIG. 5 is a three-dimensional perspective view of the embodiment illustrated in FIG. 2 shown in use strapped on an infant.

As will be seen most clearly in FIGS. 3 and 4, shield portion 3 generally comprises an outer fabric pocket or cover 5 manufactured from a preferably soft or padded material to provide a comfortable surface for the infant to rest on (e.g. a quilted blanket like material). Most preferably, fabric pocket/cover 5 is comprised of a pliable material (or materials) which can be folded and/or rolled and which is washable in conventional washing machines (so that the apparatus is easily cleanable). In still further preferred embodiments, shield 3 includes an inner layer 6 (e.g. inside pocket 5) constructed from a flexible/pliable, liquid impermeable material so that waste does not soak through one side of shield 3 to another or to removable insert 7 (so that insert 7 requires less frequent cleanings). In this regard, then, in one particularly efficacious embodiment, shield 3 is constructed from a natural and/or synthetic fiber outer shell (i.e. pocket 5), an inner liquid impermeable shell 6, and a layer of padding 5' (e.g. for comfort) located therebetween. In such an embodiment, any liquid (e.g. urine) or other waste which contacts the outer shell will not simply run or flow off the shield and onto the changing surface (or person), but instead will absorb, to a degree, in the outer shell surface and underlying padding. Employing the inner liquid impermeable layer, however, little or no waste will soak through the entire thickness of the sandwich formed by pocket 5 and inner layer 6 but instead will be contained by the impermeable layer (i.e. layer 6). Therefore, in this embodiment, if there is a diaper spill or other similar accident, waste will not penetrate through shield 3 and therefore will not soil either removable insert 7 or the changing surface. Other embodiments not utilizing such a sandwich or an impermeable layer are, of course, contemplated (e.g. a single layer of natural or synthetic fabric with or without padding material). In alternative embodiments, fabric/pocket 5 is simply "waterproof" e.g. treated with a liquid impermeable material. In further alternative embodiments, shield 3 is provided with an anti-skid undersurface (e.g. rubber or similar material overlaid over the bottom surface of pocket 5).

In at least one embodiment, as illustrated in FIG. 3, insert 7 is housed within pocket/cover 5. Insert 7 is preferable constructed of a rigid, liquid impermeable material to provide structural rigidity to apparatus 1 as well as to provide an additional liquid barrier layer (e.g. particularly for embodiments which do not employ an inner liquid impermeable layer on pocket/cover 5). Examples of useful materials, in this regard, are plastics, treated particle board, or manufactured woods. Plastic is preferred however, because some yield or flexibility in insert 7 is generally desired and because such materials are naturally liquid resistant and do not require treatments or coatings.

Insert 7 may comprise a singular rectangular sheet or, further optionally, may be subdivided into two or more generally rectangular portions connected by one or more preferably liquid impermeable living hinges (flexible/pliable hinges having no moving parts). In a particularly preferred embodiment, such as illustrated in FIG. 3, insert 7 is comprised of three rectangular panels P1, P2, and P3 connected by two living hinges 15 and 17. In particular, such a construction allows insert 7 and therefore apparatus 1 to be folded (accordion-like) into a small package for storage and/or transport (see FIG. 1). In yet even further embodiments, an additional padding material 8 can be provided in the same configuration as insert 7 (see FIG. 3).

Optionally, an elastic strap 19 is provided attached to shield 3 that may be stretched over apparatus 1 to maintain it in a folded configuration.

Opening 21 is provided in shield 3 for insertion and removal of insert 7 and includes a closure flap 9 employing a hook and fiber arrangement (e.g. Velcro™) as a securing mechanism. Alternate mechanisms of closure are, of course, contemplated.

In alternative embodiments, insert 7 is not used and existing conventional diaper changing pads/boards (e.g. foam pads, or particle board sheets) can be combined with the shield and strap system of the subject invention instead. In such an embodiment, apparatus 1 serves much like a slip cover, except with the unique features as described above. As may be expected, any known diaper changing board or pad can simply be inserted into opening 21 of shield 3 thereby to complete the restraining/barrier apparatus according to one embodiment of the subject invention.

Figure 6:
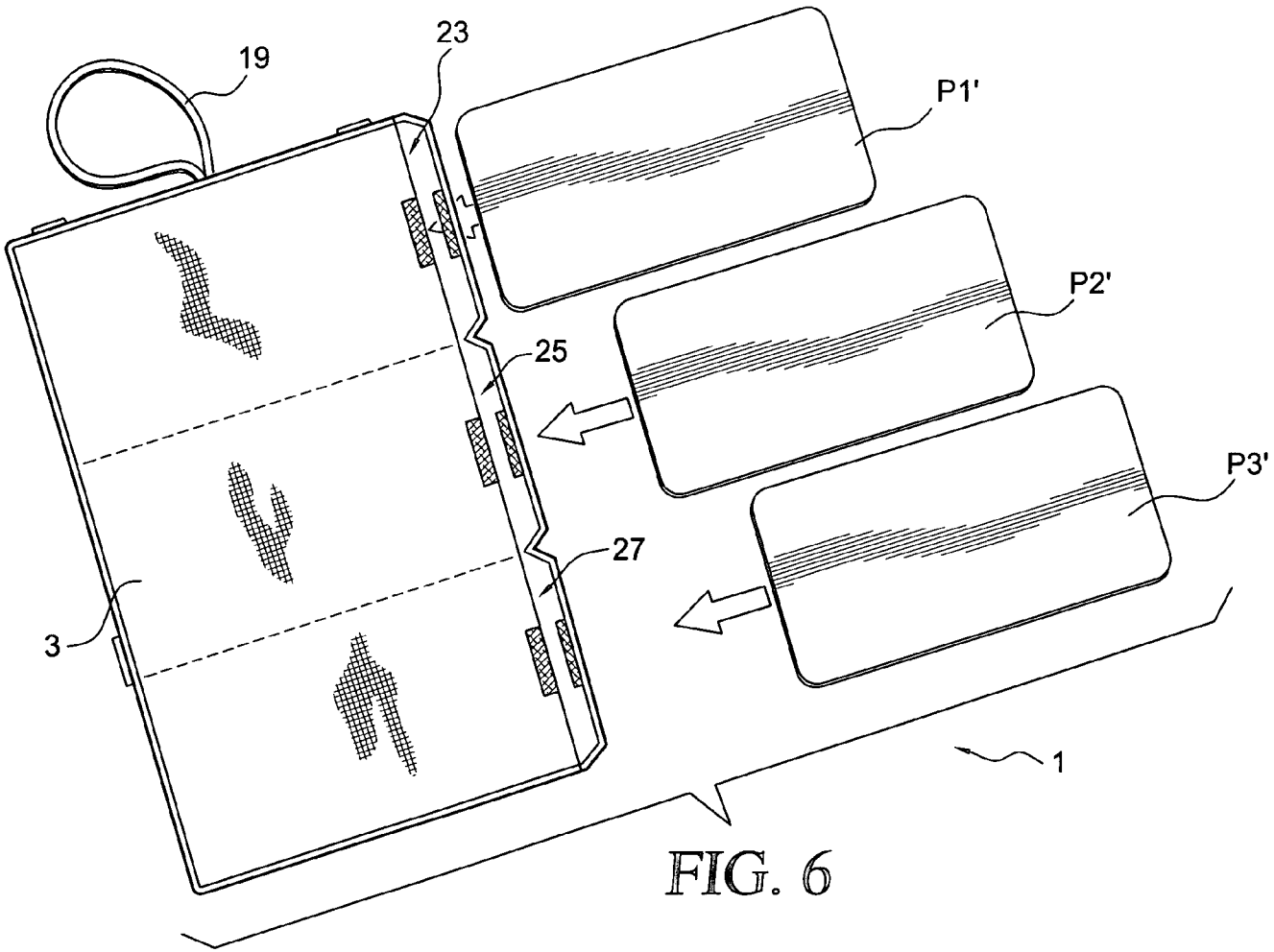
FIG. 6 is a blown-apart view of an alternative embodiment according to the subject invention.

In still further alternative embodiments, such as illustrated in FIG. 6, insert 7 is replaced with three individual (i.e. separate), generally rectangular sections P1', P2', and P3' (i.e. not connected to each other) which can be inserted or removed together or alone at will. In such an embodiment, three openings 23, 25, and 27 are provided for receiving each of the respective three insert portions. Each opening is separated internally (e.g. into compartments) by a restriction formed by conventional sewing techniques or other means. It is noted, however, that conventional sewing techniques provide liquid barrier failure points in shield 3 (e.g. areas in which liquid may permeate). Therefore, other methods of forming the internal compartments are preferred (e.g. adhesives, etc.). Alternatively, the holes created by the sewing process can be sealed using conventional sealants or sealing methods over the sewn areas. In still further preferred embodiments, the strap system alone (straps 11*a–b*) can be adapted to a conventional changing table (e.g. without utilizing shield 3).

Once given the above disclosure, many other features, modifications, and improvements will become apparent to the skilled artisan. Such other features, modifications, and improvements are therefore considered to be part of this invention, the scope of which is to be determined by the following claims.

I claim:

1. Apparatus for restraining an infant during a diaper changing operation and for shielding a changing surface and/or diaper changer during a diaper changing operation, said apparatus comprising:

a generally planar shield portion having an upper surface for supporting an infant and a lower surface for contacting a diaper changing support surface, said shield portion comprising a fabric pocket, said fabric pocket having a compartment having an aperture housing at least one generally rigid, removable insert, said insert comprising a generally stiff barrier material, said insert having at least one living hinge portion separating at least two major surfaces of said insert, said at least two major surfaces being foldable one on top of the other such that said shield portion is foldable into a compact unit;

said fabric pocket having a top portion and a bottom portion and a middle portion extending between said top and said bottom portions; and a restraining mechanism for restraining shoulders of an infant during a diaper changing operation, said restraining mechanisms comprising an adjustable strap system, said adjustable strap system having at least a right strap and a left strap, said right and left straps connecting to said fabric pocket proximal said top portion at one end and proximal said middle portion at another end, and each said right and left straps including a matable element of a quick release system and being connectable one to the other by engaging said matable elements of said quick release system.

2. An apparatus for restraining an infant according to claim 1 wherein each said right and left strap is adjustable in length.

3. An apparatus for restraining an infant according to claim 2 wherein said insert comprises at least two living hinge portions separating at least three major surfaces, each of said at least three major surfaces being foldable on top of an adjacent major surface such that said shield portion is foldable into a compact unit.

4. An apparatus for restraining an infant according to claim 3 wherein said insert comprises a material which is substantially liquid impermeable.

5. An apparatus for restraining an infant according to claim 4 wherein said fabric pocket comprises a cushioned material for providing a comfortable changing surface for an infant.

6. An apparatus according to claim 5 wherein said fabric pocket includes an opening through which said insert can be removed or replaced, said opening having a closing mechanism for closing said opening when said apparatus is being used, stored, or transported.

7. An apparatus according to claim 6 further including a securing strap attached to a portion of said fabric pocket capable of maintaining said major surfaces as a folded unit for transport or storage purposes.

8. An apparatus according to claim 7 wherein said matable elements of said quick release system comprise male and female portions for connecting one to the other.

9. Apparatus according to claim 3 wherein said fabric pocket includes an inner liquid impermeable shell.

10. Apparatus according to claim 9 wherein said fabric pocket includes an outer liquid permeable shell and a layer of padding sandwiched between said inner and said outer shells.

11. An apparatus for restraining an infant according to claim 5 wherein said lower surface of said shield portion includes an antiskid surface.

12. Apparatus for restraining an infant during a diaper changing operation and for shielding a changing surface and/or diaper changer during a diaper changing operation, said apparatus comprising:

a generally planar shield portion having an upper surface for supporting an infant and a lower surface for contacting a diaper changing support surface, said shield portion comprising a fabric pocket, said fabric pocket having a plurality of compartments having apertures separated one from another by restriction portions, each of said plurality of compartments housing one of a plurality of generally rigid, removable inserts, each said insert comprising a generally stiff barrier material;

said fabric pocket being foldable at said restriction portions such that said fabric pocket is foldable into a compact unit;

said fabric pocket having a top portion and a bottom portion and a middle portion extending between said top and said bottom portions; and a restraining mechanism for restraining shoulders of an infant during a diaper changing operation, said restraining mechanism comprising an adjustable strap system, said adjustable strap system having at least a right strap and a left strap, said right and left straps connecting to said fabric pocket proximal said top portion at one end and proximal said middle portion at another end, and each said right and left straps including a matable element of a quick release system and being connectable one to the other by engaging said matable elements of said quick release system.

13. Apparatus according to claim 12 wherein said fabric pocket includes an inner liquid impermeable shell.

14. Apparatus according to claim 13 wherein said fabric pocket includes an outer liquid permeable shell and a layer of padding sandwiched between said inner and said outer shells.

* * * * *